US009410356B2

(12) United States Patent
Yuhas

(10) Patent No.: US 9,410,356 B2
(45) Date of Patent: Aug. 9, 2016

(54) CURVED DOOR

(71) Applicant: AS IP HOLDCO, LLC, Piscataway, NJ (US)

(72) Inventor: Drew Yuhas, Pennington, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 0 days.

(21) Appl. No.: 13/931,577

(22) Filed: Jun. 28, 2013

(65) Prior Publication Data

US 2015/0000196 A1 Jan. 1, 2015

(51) Int. Cl.

| | |
|---|---|
| ***E06B 3/46*** | (2006.01) |
| ***E06B 3/70*** | (2006.01) |
| ***A47K 3/34*** | (2006.01) |

(52) U.S. Cl.

CPC ..... *E06B 3/4636* (2013.01); *A47K 3/34* (2013.01); *E06B 3/7007* (2013.01)

(58) Field of Classification Search

CPC ..... A47K 3/34; E06B 3/4636
USPC ..... 49/38, 39, 40, 41, 61, 63, 409, 410, 49/411, 125; 4/607, 610
See application file for complete search history.

(56) References Cited

U.S. PATENT DOCUMENTS

| | | | | | |
|---|---|---|---|---|---|
| 1,997,420 | A | * | 4/1935 | Kiekert | 49/125 |
| 2,028,628 | A | * | 1/1936 | Sherron | 49/40 |
| 3,052,930 | A | * | 9/1962 | Mathews | 49/411 |
| 3,350,739 | A | * | 11/1967 | Rifkin | 16/90 |
| D217,866 | S | | 6/1970 | Myers | |
| 4,114,331 | A | * | 9/1978 | Yamamoto | 52/202 |
| 4,178,718 | A | * | 12/1979 | Laby | 49/411 |
| 4,545,630 | A | * | 10/1985 | Izumi | G01D 11/24 177/238 |
| 4,807,312 | A | | 2/1989 | Baus | |
| 4,882,795 | A | * | 11/1989 | Baus | 4/607 |
| 4,974,269 | A | | 12/1990 | Baus | |
| D352,548 | S | | 11/1994 | Pinsky et al. | |
| D374,917 | S | | 10/1996 | Casden | |
| 5,575,022 | A | * | 11/1996 | Duffy et al. | 4/607 |
| D392,724 | S | | 3/1998 | Lenardon | |
| 5,839,228 | A | * | 11/1998 | Duffy | 49/223 |
| 5,852,837 | A | * | 12/1998 | Husting | 4/607 |
| 5,987,817 | A | * | 11/1999 | Hein | 49/40 |
| 6,023,889 | A | | 2/2000 | Husting et al. | |

(Continued)

FOREIGN PATENT DOCUMENTS

DE 4125069 3/1992

OTHER PUBLICATIONS

MTI Baths, Enclosures—Shower Enclosures—Crescent Bow-Front Enclosure—N60BF, http://mtibaths.com/products/enclosures/shower/N60BF, retrieved on Mar. 11, 2013.

(Continued)

*Primary Examiner* — Gregory Strimbu
(74) *Attorney, Agent, or Firm* — Ladas & Parry LLP

(57) ABSTRACT

A curved bypass door suitable for a shower or bath comprising a first door, a second door set back from the first door, and an upper track made of aluminum. In one aspect, the upper track has a lower rail adapted to receive a first roller for the first door and an upper rail adapted to receive a second roller for the second door. In another aspect, the upper rail is adapted to receive the roller of the second door and the lower rail is adapted to receive and fixedly hold the first door. Each door curvature such that both doors together form the curved bypass door. The upper track is curved to match the shape of the curved bypass door.

15 Claims, 23 Drawing Sheets

(56) References Cited

U.S. PATENT DOCUMENTS

| | | | | |
|---|---|---|---|---|
| D444,862 | S | 7/2001 | Slothower | |
| 6,698,037 | B2 | 3/2004 | Lippe | |
| 6,792,721 | B1 | 9/2004 | Montanari | |
| 6,895,714 | B2 * | 5/2005 | Teubert et al. | 49/505 |
| D571,441 | S | 6/2008 | Sauvageau et al. | |
| D590,052 | S | 4/2009 | Murphy | |
| 8,495,772 | B2 | 7/2013 | Boonstra | |
| D709,601 | S | 7/2014 | Sullivan | |
| 2003/0208842 | A1 | 11/2003 | Laws | |
| 2006/0277829 | A1 * | 12/2006 | Kiefer | 49/40 |
| 2010/0031438 | A1 | 2/2010 | Boonstra | |

OTHER PUBLICATIONS

MTI Baths, Shower Bases—Designer Shower Bases—MTSB-6027-36, http://mtibaths.com/products/shower-bases/designer/MTSB-6027-36, retrieved on Mar. 11, 2013.

Fleurco, Novara, Bowfront 60, Curved Door and Panel, http://fleurco.com/shower-doors/novara-bowfront-60.aspx, retrieved on Mar. 11, 2013.

Fleurco, Roma, Bowfront, Curved Door and Panel, http://fleurco.com/shower-doors/roma-bowfront.aspx, retrieved on Mar. 11, 2013.

Fleurco, Banyo, Amalfi Bowfront, Semi-Frameless Curved Sliding Door With Return Panel, http://fleurco.com/shower-doors/banyo-amalfi-bowfront-2-sides-semi-frameless-sliding-door.aspx, retrieved on Mar. 11, 2013.

Fleurco, Sorrento, Bowfront, Curved Door and Panel With Return Panel, http://fleurco.com/shower-doors/Bowfront-Curved-Door-and-Panel-with-Return-panel-131.aspx, retrieved on Mar. 11, 2013.

Fleurco, Bowfront Acrylic Shower Base, http://fleurco.com/bases/Bowfront-Acrylic-Shower-Base.aspx, retrieved on Mar. 11, 2013.

English abstract of DE4125069 (A1).

* cited by examiner

CURVED DOOR

BACKGROUND OF THE INVENTION

1. Field of the Invention

The present invention generally relates to a curved door, particularly for showers and bath tubs.

2. Related Art

Standard flat or straight shower or tub doors have a number of disadvantages. For example, shower or tub doors that are straight and not curved lead to a loss of space and "elbow room" in the shower. Also, since the shower base typically matches the shape of the shower door (e.g., a base for a standard flat shower door is rectangular), the resulting area that the user stands within is smaller.

There exists, therefore, a need to provide a novel curved shower or tub door and a method for making the same that overcomes the above-noted and other drawbacks of existing shower doors and methods. To this point it has been difficult to design and manufacture a curved shower or tub door (particularly a sliding curved door that fits within a traditional bath tub or shower space, as opposed to for example a corner space) due to certain technical hurdles and problems which have been overcome by the present invention, as explained in detail herein.

SUMMARY OF THE INVENTION

The foregoing and other problems are overcome by a curved door and a method for making the same. The curved door of the present invention is particularly suited for, e.g., showers and bath tubs including those that fit into a traditional bath tub or shower space, but it is not limited to those applications.

The invention in one aspect comprises a curved "bypass" shower door which can align with a matching curved shower base. As opposed to rectangular shower bases, the curved shower base extends beyond the rectangular footprint at its center so that the user has a wider area to stand within. Likewise, the curved shower door allows for more "elbow room" compared to a standard flat shower door. The curved shower door has bypass door panels which allow the user to enter or exit from either side of the unit. The bypass door panels both slide. In another embodiment, one of the door panels may be fixed (at one side or the other) and thus not slide.

Accordingly, in this aspect of the invention, the curved shower door matches with the shower base that has a curved front. The curved shape of both the shower door and the base can afford a more generous space for the user to shower and move within. Moreover, as noted, the bypass curved shower door panels allow the user to enter or exit from either side (e.g., left or right) of the unit. The invention can be fitted with complimentary shower walls.

It is noted that the curved door of the present invention can be provided for a tub as well, with similar advantages and effects. The curved tub door can allow for more "elbow room" compared to a standard flat tub door. The curved tub door has bypass door panels which enable the user to enter or exit from either side of the unit. The bypass door panels may both slide. In another embodiment, one of the door panels may be fixed (at one side or the other) and thus not slide.

Accordingly, the present invention in one aspect provides a curved bypass door, comprising a first door, a second door set back from the first door, and an upper track made of aluminum. The upper track has a lower rail adapted to receive a first roller for the first door to slide on and an upper rail adapted to receive a second roller for the second door to slide on. Each door has a curvature such that both doors together form the curved bypass door. The upper track is curved to match the shape of the curved bypass door.

The present invention in another aspect provides a curved door, comprising a first door that is fixed to a guide, a second door that slides and is set back from the first door, and an upper track made of aluminum. The upper track has an upper rail adapted to receive a roller for the second door to slide on and a lower rail adapted to hold the first door. Each door has a curvature such that both doors together form the curved door. The upper track is curved to match the shape of the curved door.

The present invention in another aspect provides a track for holding, receiving, or hanging a curved bypass door. The track is a curved upper track that comprises a lower rail adapted to receive a first roller for a first door to slide on, and an upper rail set back from the lower rail and adapted to receive a second roller for a second door to slide on.

The present invention in another aspect provides a track for holding, receiving, or hanging a curved door that is comprised of a fixed door and a sliding door. The track is a curved upper track having (1) a lower rail adapted to receive a guide for receiving a fixed door, and (2) an upper rail set back from the lower rail and adapted to receive a roller for a sliding door to hang from and slide on.

Further features and advantages of the present invention as well as the structure and operation of various embodiments of the present invention are described in detail below with reference to the accompanying drawings.

BRIEF DESCRIPTION OF THE DRAWINGS

The features and advantages of the present invention will be more readily understood from a detailed description of the exemplary embodiments taken in conjunction with the following figures, which are not necessarily drawn to scale:

FIG. 23, which includes

The invention will next be described in connection with certain exemplary embodiments; however, it should be clear to those skilled in the art that various modifications, additions, and subtractions can be made without departing from the spirit or scope of the claims.

DETAILED DESCRIPTION OF THE PREFERRED EMBODIMENTS

FIGS. 1-11 show various views of the curved door according to a first embodiment, wherein the curved door is a bypass door such that both doors slide.

FIGS. 12-21 show various views of the curved door according to a second embodiment, wherein one side (in this case the right door) is fixed and the left door slides. Of course, in another embodiment, the left door may be fixed and the right door may slide. This would be a similar arrangement to that shown in FIGS. 12-21, except with the sliding and fixed doors reversed such that the new arrangement would be a mirror image of the arrangement shown in FIGS. 12-21.

Figure 1:
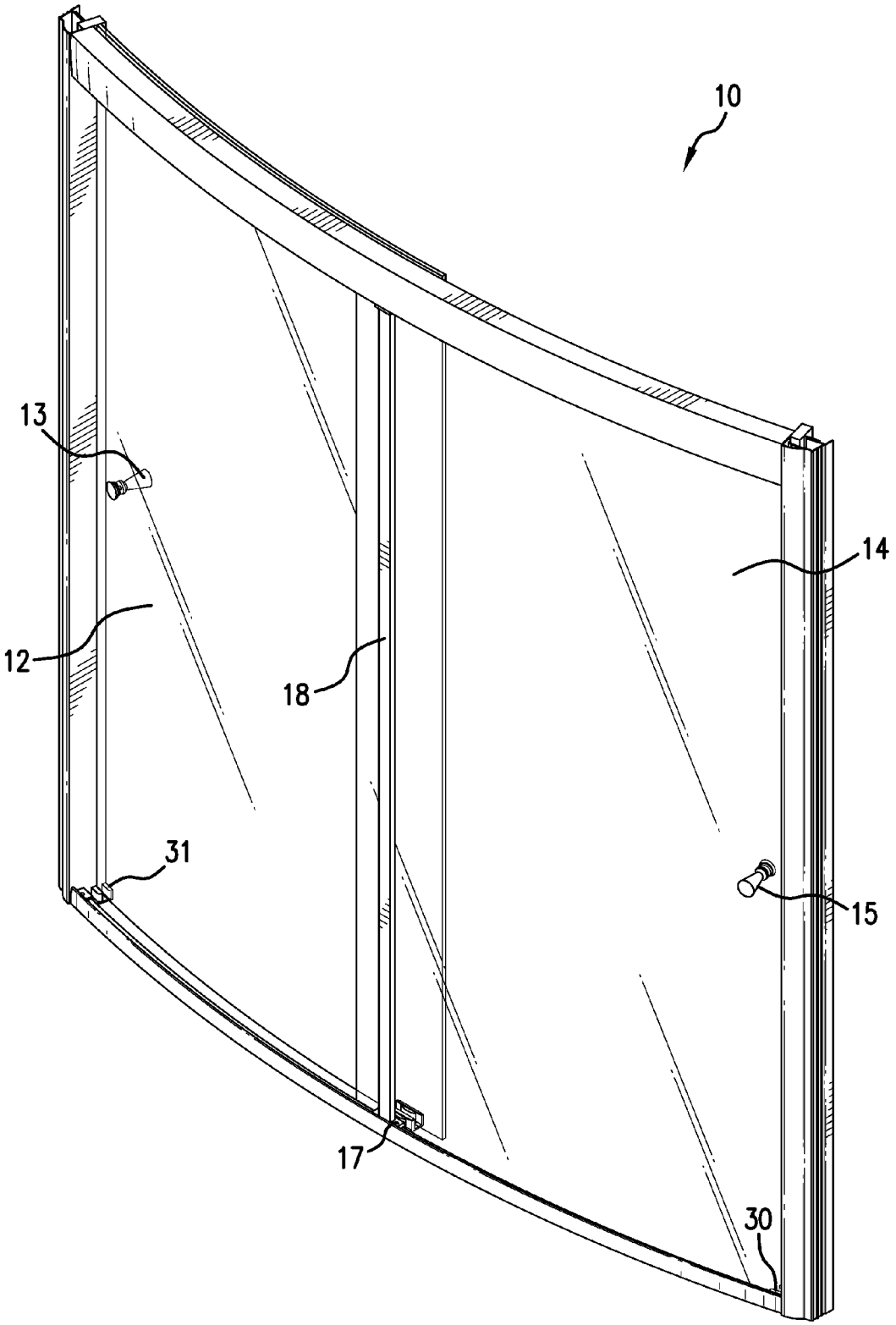
FIG. 1 is a perspective view showing a curved bypass door with both doors closed according to a first embodiment.
Figure 2:
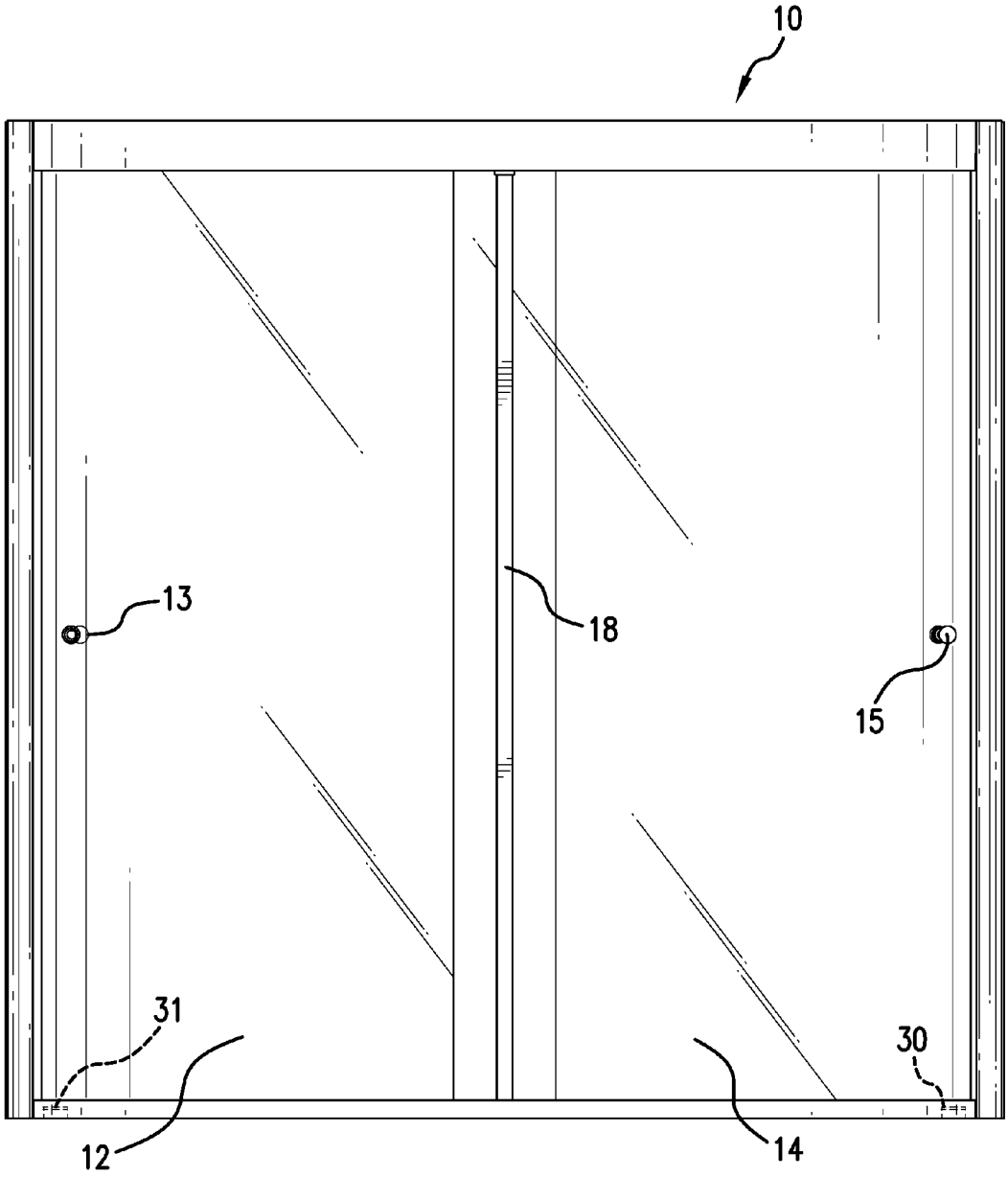
FIG. 2 is a front view showing a curved bypass door with both doors closed according to the first embodiment.

In more detail, FIG. 1 shows a perspective view of a curved bypass door 10 according to one embodiment of the present invention. The curved bypass door 10 has a left panel 12 and a right panel 14, both shown in FIG. 1 in the closed position. The left panel 12 is set back slightly from the right panel 14 to allow the doors to slide past each other, and each panel 12, 14 has a handle 13, 15 for sliding the panel open or closed. For the purposes of this disclosure, the terms left, right, front, back, upper, and lower will be used relative to the front view. Vertical bar 18 is preferably employed to support the upper track.

Figure 8:
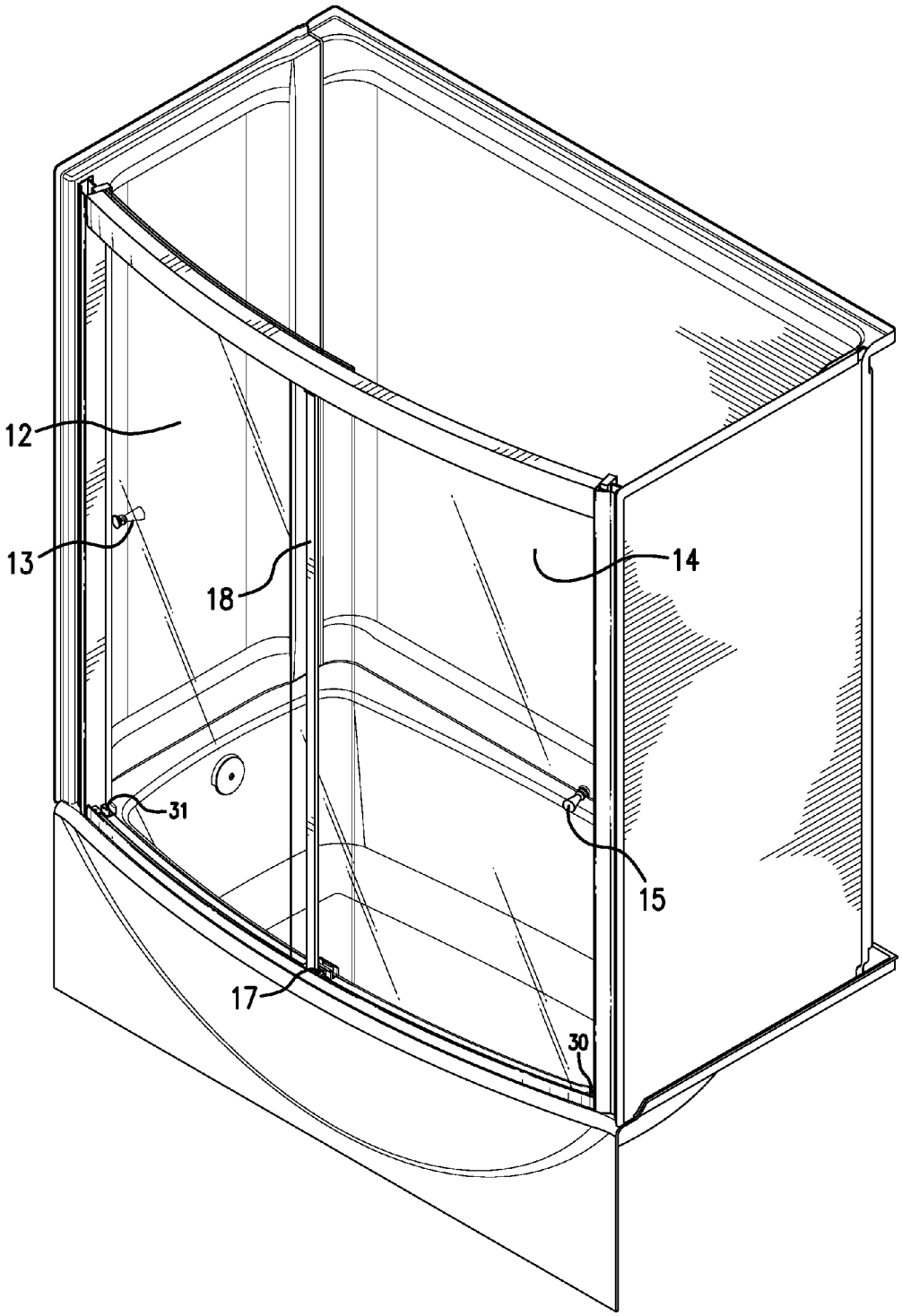
FIG. 8 is a perspective view showing a curved bypass door with both doors closed according to the first embodiment, as used with a tub.
Figure 9:
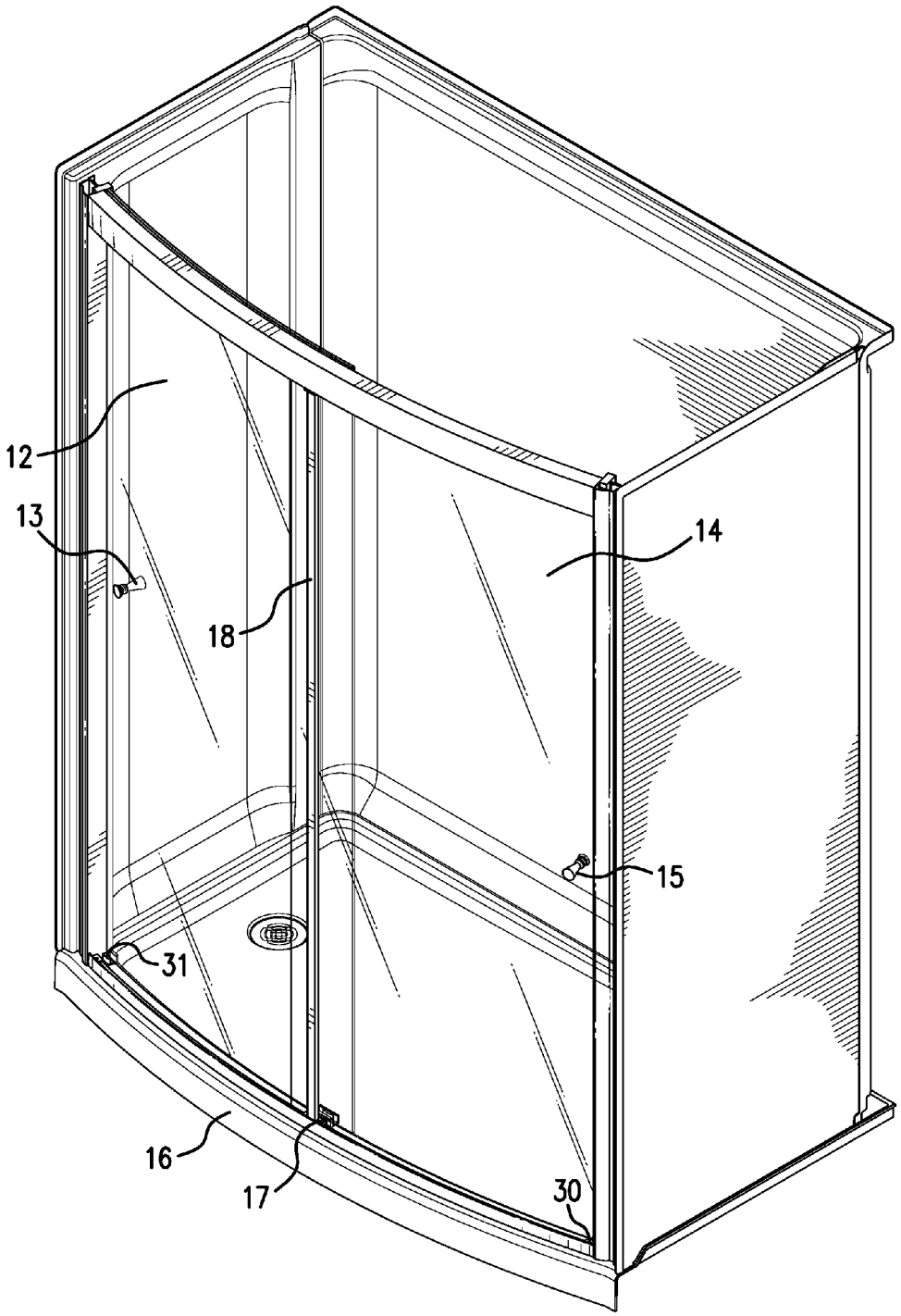
FIG. 9 is a perspective view showing a curved bypass door with both doors closed according to the first embodiment, as used with a shower.
Figure 10:
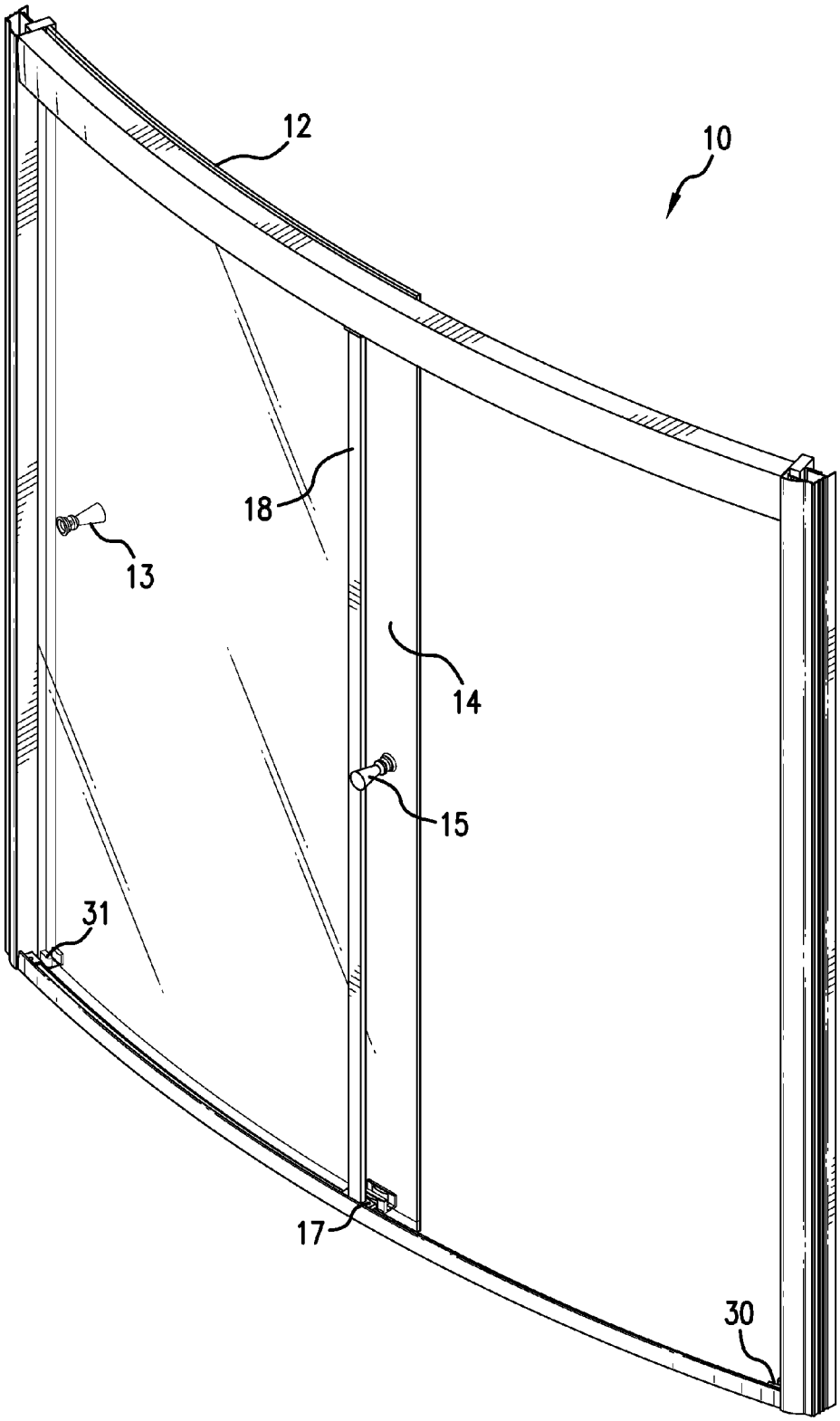
FIG. 10 is a perspective view showing a perspective view of a curved bypass door according to the first embodiment, with the right door open.
Figure 11:
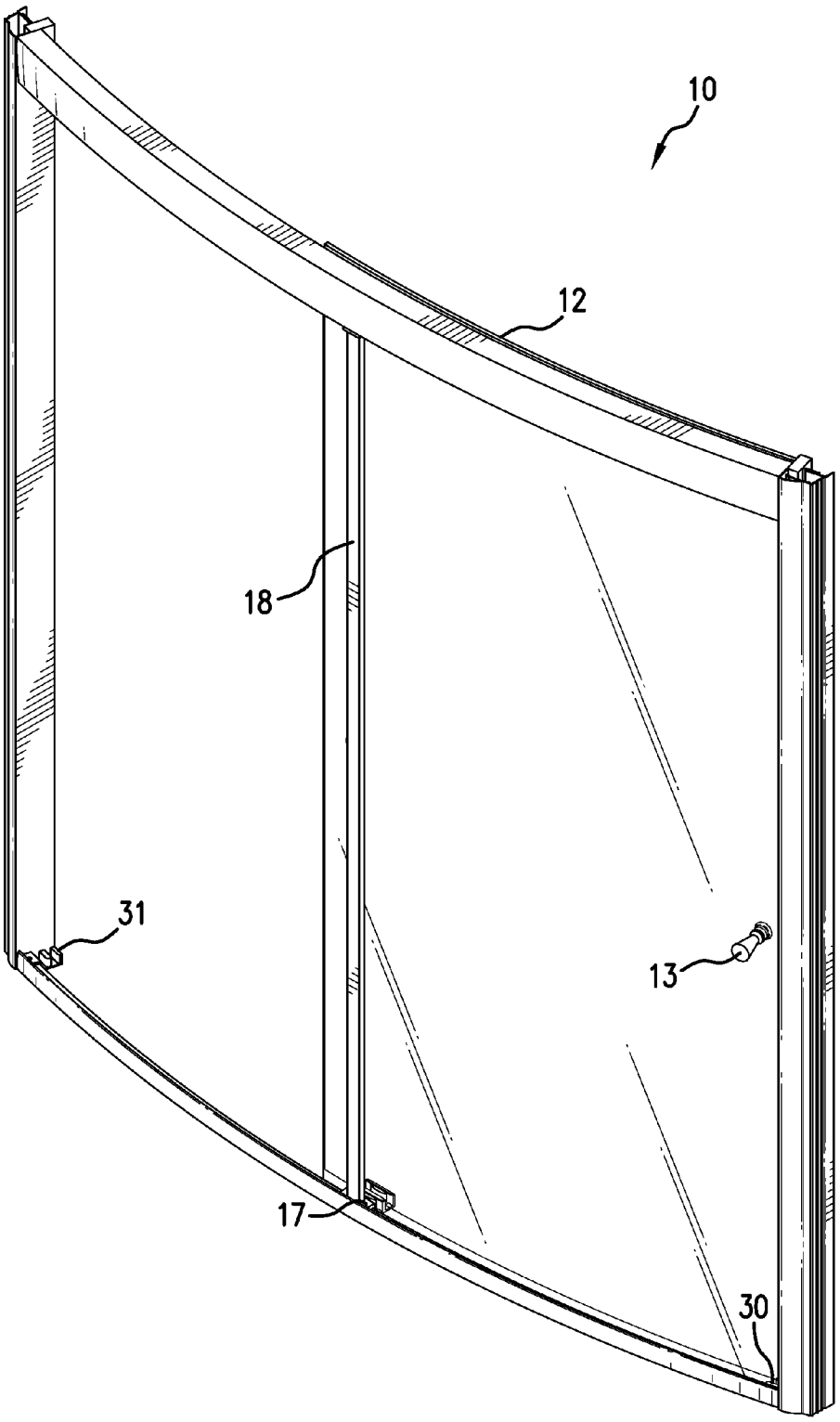
FIG. 11 is a perspective view showing a perspective view of a curved bypass door according to the first embodiment, with the left door open.
Figure 12:
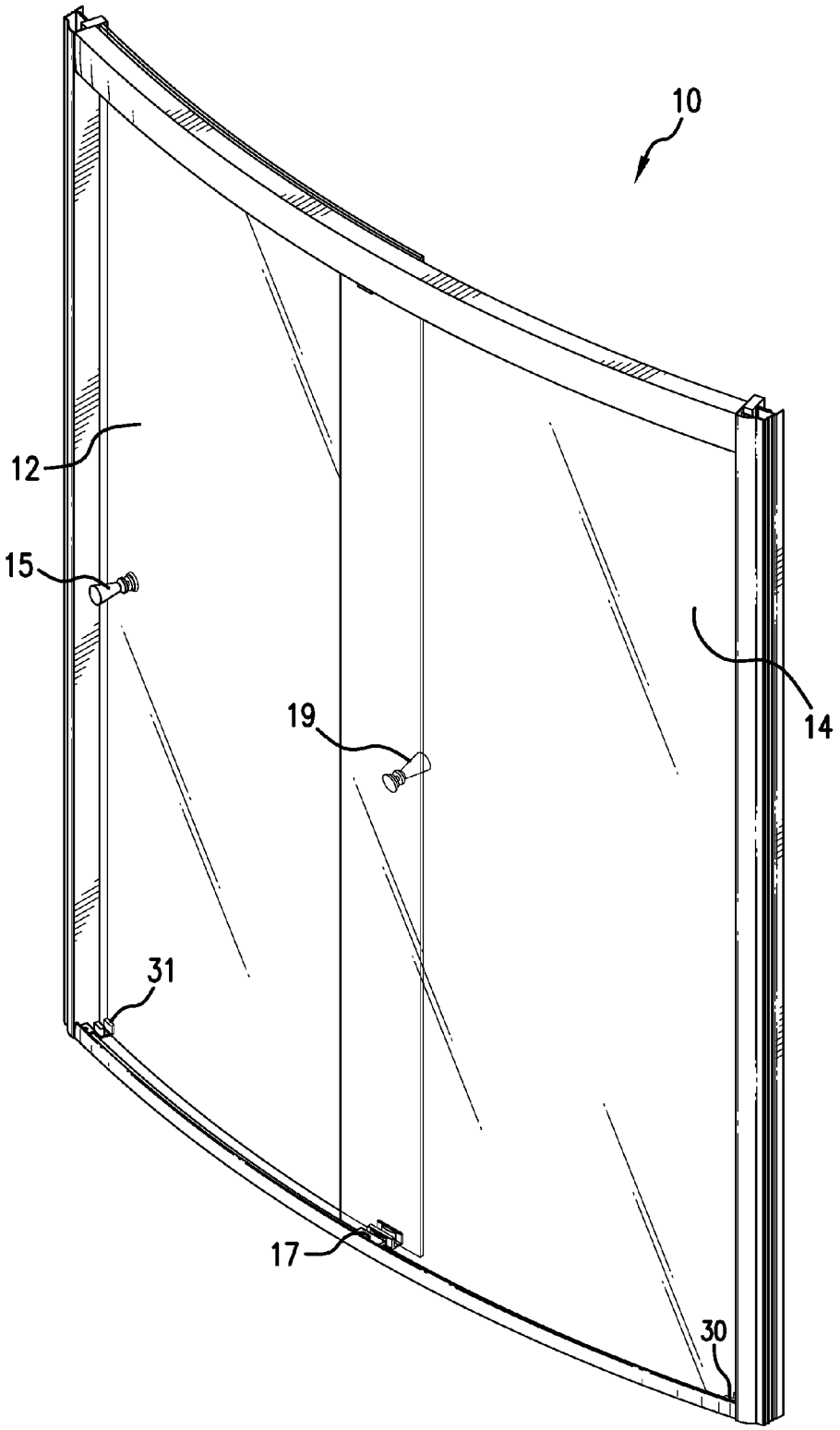
FIG. 12 is a perspective view showing a perspective view of a curved door with one side (the right door) fixed and the left (sliding) door closed, according to a second embodiment.
Figure 13:
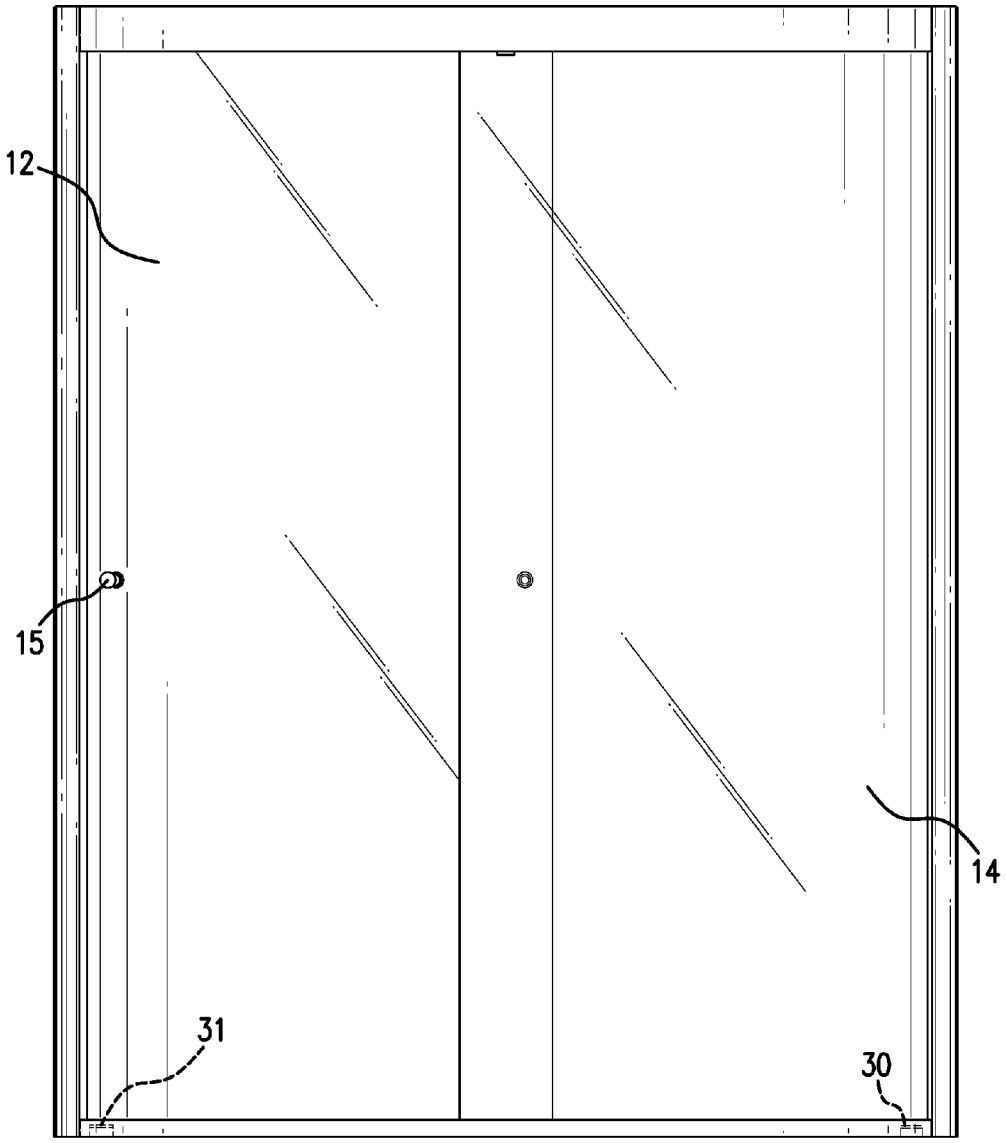
FIG. 13 is a front view showing a front view of a curved door with one side (the right door) fixed and the left door closed, according to the second embodiment.

While only the curved door itself is shown in FIG. 1, FIG. 9 illustrates a perspective view of the curved door for use with a shower. FIG. 8 illustrates a perspective view of the curved door for use with a tub.

As noted above, there are various technical reasons why to this point it has been difficult to design and manufacture a curved shower or tub door. These technical hurdles and problems can be overcome by the present invention, as now explained.

First, existing sliding "straight" doors, either of the bypass variety or of the type in which one side is fixed and the other side slides, typically have upper tracks made from aluminum that are generally in a "C" shape with the door hanging locations opposite to each other and at the same height. See for example FIG. 26. Thus, the front door 20 and the back door 22 are at the same height. However, if one attempts to bend the "C" shaped upper track 24 in order to create a curved design, the track will crack or collapse due to the limitations in current bending technology with aluminum structures. Both doors would not be able to slide on such a curved design. There is also the matter that the extrusion must be wide enough to fit front and back rollers.

In contrast to such configuration of conventional tracks for straight doors, in the configuration of the present invention the door hanging locations are one above the other. See, for example, the side view of the upper track 2 shown in FIG. 22, which has a front door 4 and a rear door 6. The front door 4 may correspond to the right door 14 of FIG. 1, and the rear door 6 may correspond to the left door 12 of FIG. 1.

Figure 22:
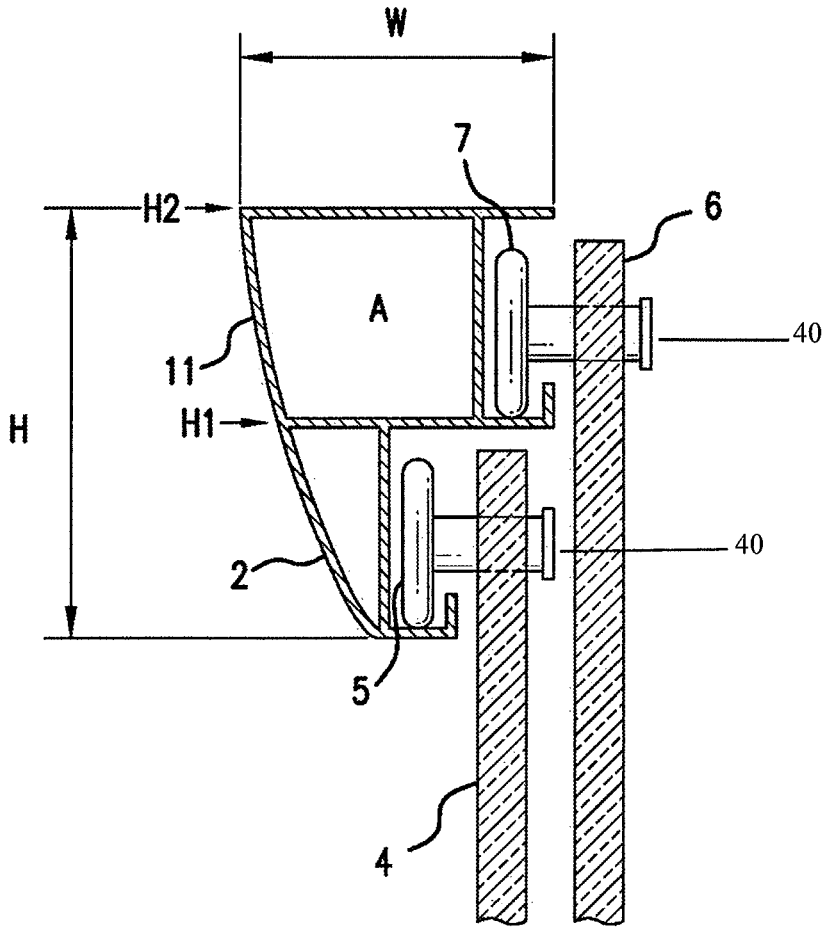
FIG. 22 is a cross-sectional view of the upper track according to the first embodiment of the present invention.
Figure 26:
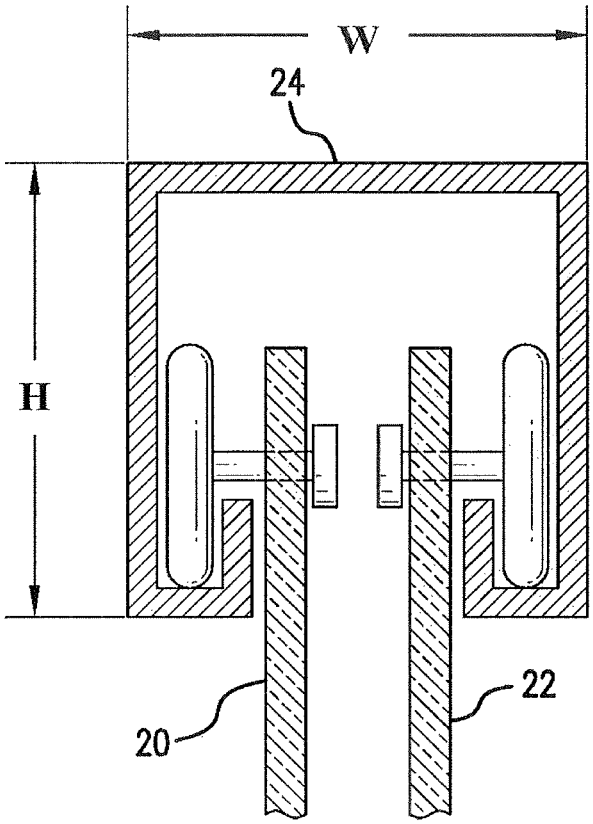
FIG.26 PRIOR ART
FIG. 26 shows a cross-sectional view of a conventional "C" shaped track for a flat or straight door.

As can be seen in FIG. 22, the front door 4 and the rear door 6 are at different heights: the front door 4 is at height H1, and the rear door 6 is at a higher height H2. This allows the upper track 2 to be narrower in the bending direction. The bending is required to meet the curved design or configuration. The revised design or configuration of the present invention allows easier bending of the extrusion to fit the curved shape of the curved bypass door. In this way, the extrusion can be prevented from cracking or collapsing when bended. See for example the box section labeled "A" in FIG. 22. In addition to being narrow, this box section contributes to the ability to bend the extrusion. Since the "C" section of the track for a flat door as shown in FIG. 26 is open on the bottom, it will collapse on bending. The box section labeled "A" as shown in FIG. 22 (and FIG. 24) cannot be achieved from the "C" section of FIG. 26.

In particular, with the present invention, in the process of making the extrusion for upper track 2, the aluminum is made to be narrower in the bending direction. It is then extruded straight and thereafter bent to make the curved shape. Thus, the extrusion can be the same width W as conventional tracks for straight doors but narrower in the bending direction so that it doesn't collapse when bent. The resulting extrusion or upper track 2 of the present invention is therefore wide enough to fit the rollers 5, 7 for the front 4 and back 6 doors, which are disposed one above the other as shown in FIG. 22. In this embodiment, the rollers 5 and 7 are attached to the doors 4 and 6 by axles 40. It is noted that the resulting extrusion or upper track 2 of the present invention is also made to be taller in height H than conventional tracks for a straight door since the tops of the doors 4, 6 of the present invention are located one above another. While the particular shape of the extrusion is shown in FIG. 22 according to one embodiment, the shape is not limited thereto, as it is of course to be understood that any suitable shape of the extrusion will work. For example, the face 11 of the upper track, shown as sloped in FIG. 22, could instead be vertical.

Figure 3:
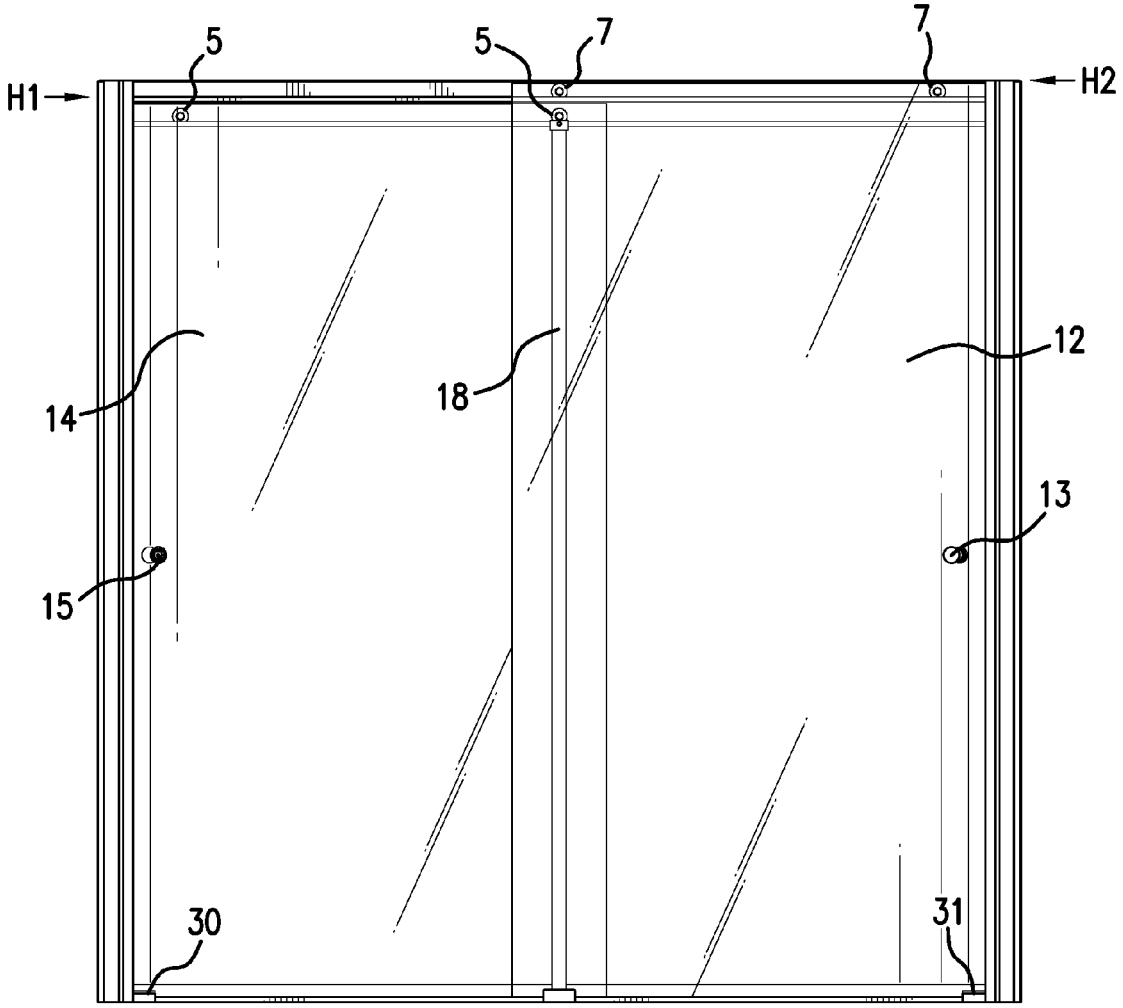
FIG. 3 is a back view showing a curved bypass door with both doors closed according to the first embodiment.
Figure 4:
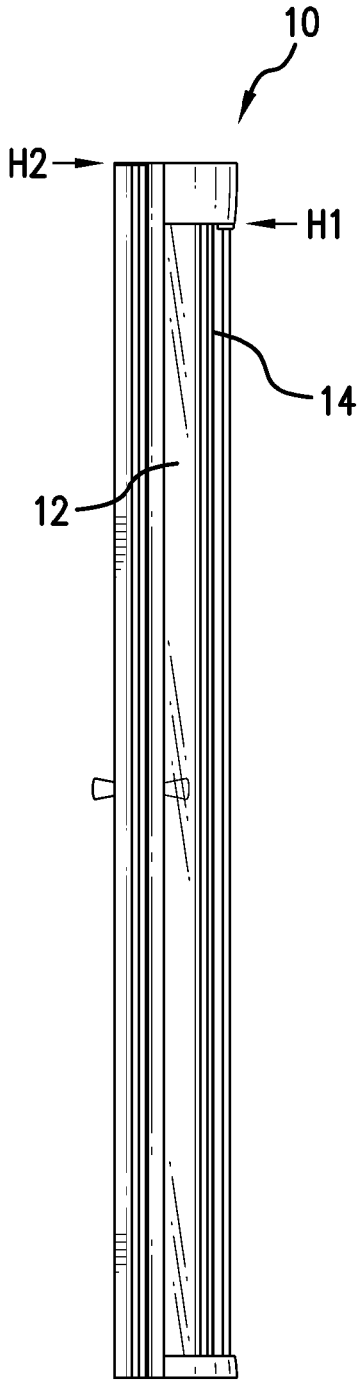
FIG. 4 is a left side view showing a curved bypass door according to the first embodiment.
Figure 5:
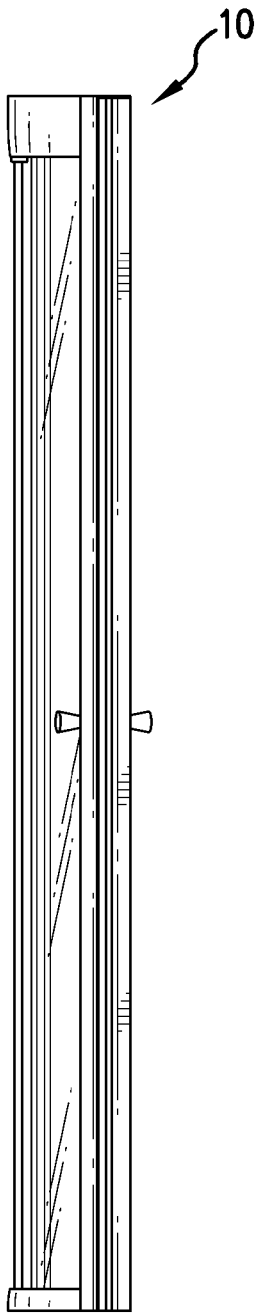
FIG. 5 is a right side view showing a curved bypass door according to the first embodiment.
Figure 6:
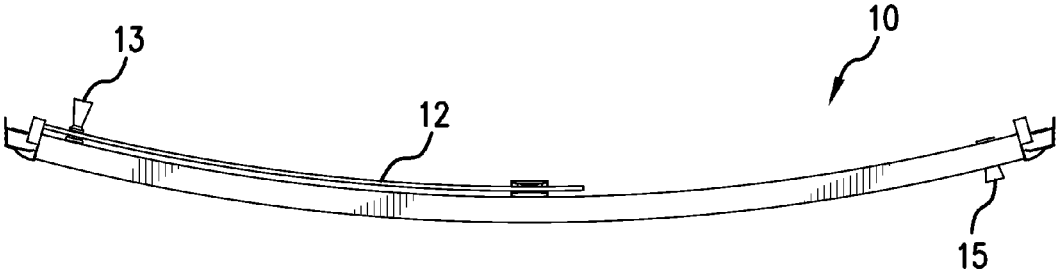
FIG. 6 is a top view showing a curved bypass door according to the first embodiment.
Figure 7:
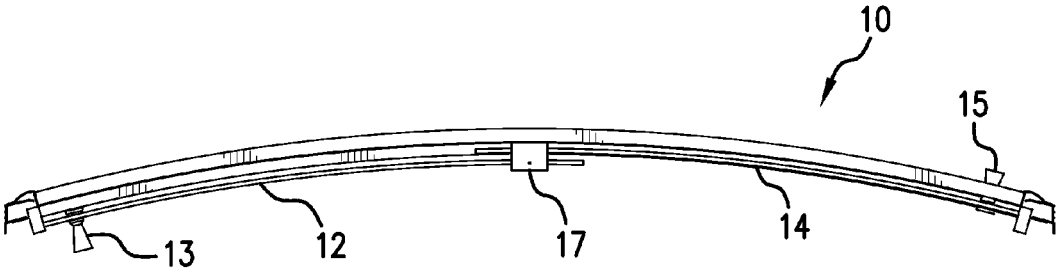
FIG. 7 is a bottom view showing a curved bypass door according to the first embodiment.

For other views of the configuration of the present invention in which the door hanging locations are one above the other, see also, e.g., the back view shown in FIGS. 3-5, wherein the right door 14 is at height H1 and the left door 12 is at height H2. Thus, the left door 12, which as noted above is set back from the right door 14, is higher than the right door 12. Of course, while the left door 12 is higher than the right door 14 in this embodiment, it is of course to be noted that the heights could be reversed such that the right door is taller than the left door.

Figure 23A:
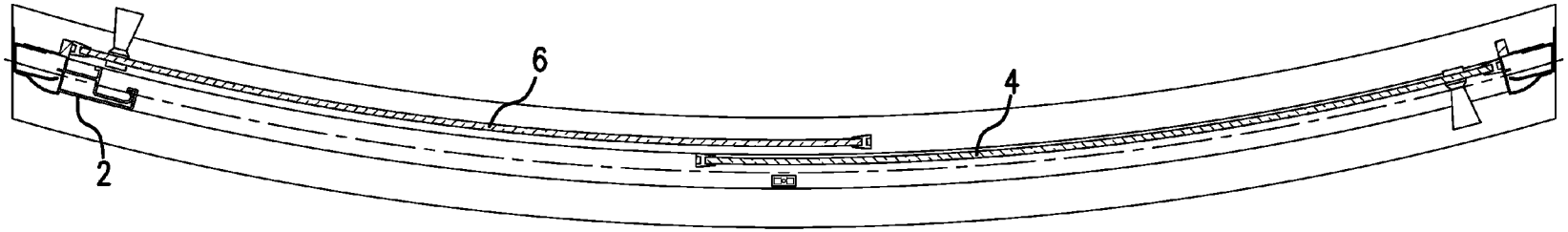
FIGS. 23A and 23B, shows views of the embodiment of FIG. 22 from the top.
Figure 23B:
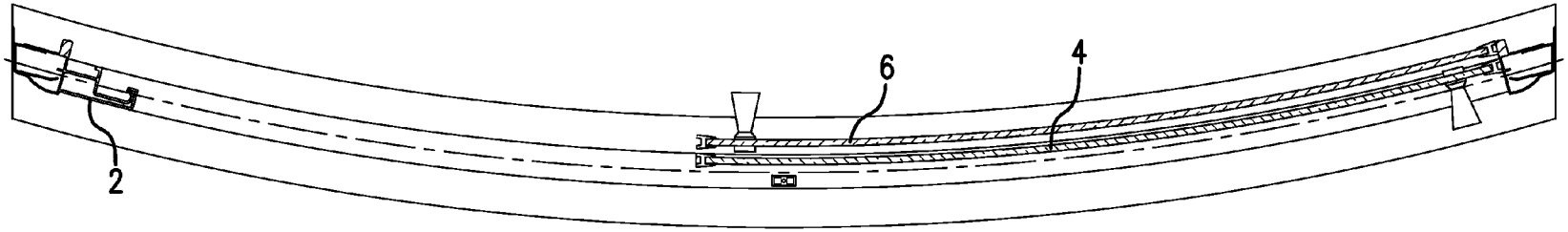

FIG. 23, which includes FIGS. 23A and 23B, shows views of this embodiment from the top. FIG. 23A shows the upper track 2 and both doors 4, 6 closed, while FIG. 23B shows the upper track 2 and the left door 6 open.

By virtue of the configuration of the present invention according to the first embodiment, both doors 4, 6 can slide. Single-wheeled rollers 5, 7 on the upper track 2 for the front door 4 and rear door 6, respectively, can be employed in a preferred embodiment. (See also rollers 5, 7 of, e.g., FIG. 3.) Rollers with more than one wheel can also be employed. In a preferred embodiment two single-wheeled rollers 5 are employed for front door 4, and two single-wheeled rollers 7 are employed for the rear door 6. For the bottom of the doors, guide(s) are employed in a preferred embodiment. For example, center guide 17 shown in FIG. 1 receives and guides left and right panel doors 12, 14. And end guides 30, 31 can receive each sliding panel door 12, 14. The guides are shown and discussed in more detail below.

Also in FIG. 1 knobs 13, 15 are shown on the respective doors 12, 14. The knobs 13, 15 are each made up of a larger knob portion and a smaller nub portion to enable the sliding doors 12, 14 to slide past each other. Thus, in FIG. 1, the larger knob portion of knob 13 faces to the rear while the smaller nub portion faces to the front, and vice versa for knob 15.

Figure 24:
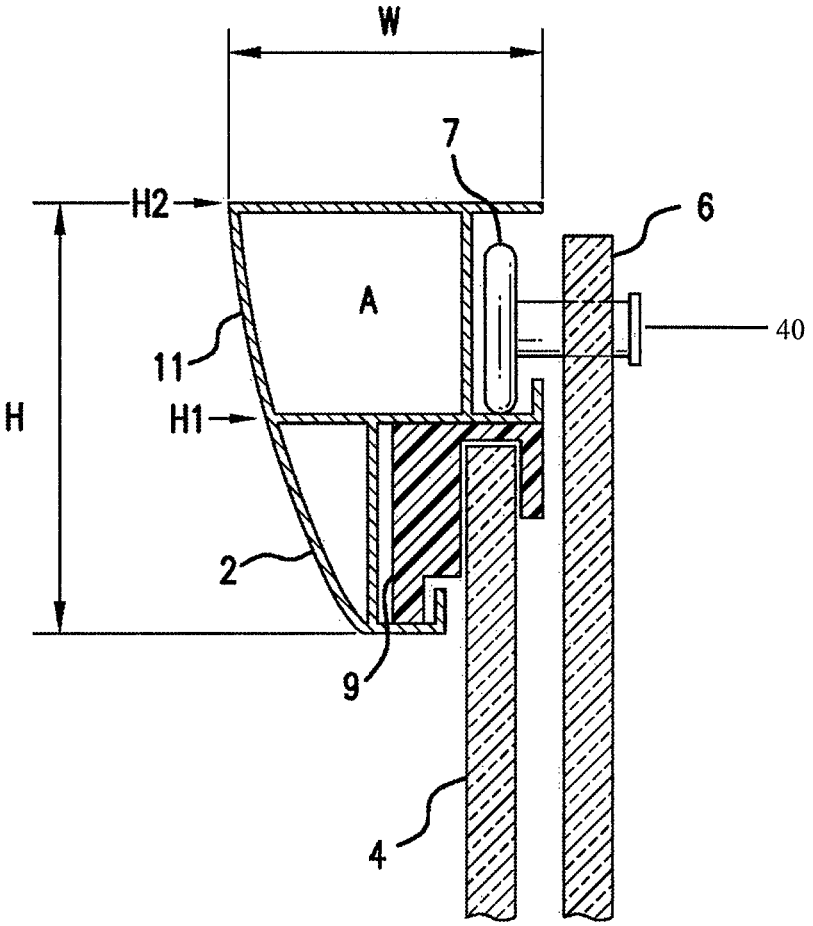
FIG. 24 is a cross-sectional view of the upper track according to the second embodiment of the present invention.

FIG. 24 is a side view of the upper track according to the second embodiment of the present invention, in which one door (either the left door or the right door) is fixed while the other door slides. Again it is noted that FIGS. 12-21 show various views of the curved door according to the second embodiment, wherein one side (in this case the right door) is fixed and the left door slides. The example shown in FIG. 12 has two knobs 15, 19 on the sliding door 12. The knobs 15, 19 are each made up of a larger knob portion and a smaller nub portion to enable the sliding door 12 to slide past the fixed door 14. Thus, in FIG. 12, the larger knob portion of knob 15 faces to the front while the smaller nub portion faces to the rear, and vice versa for knob 19.

Figure 14:
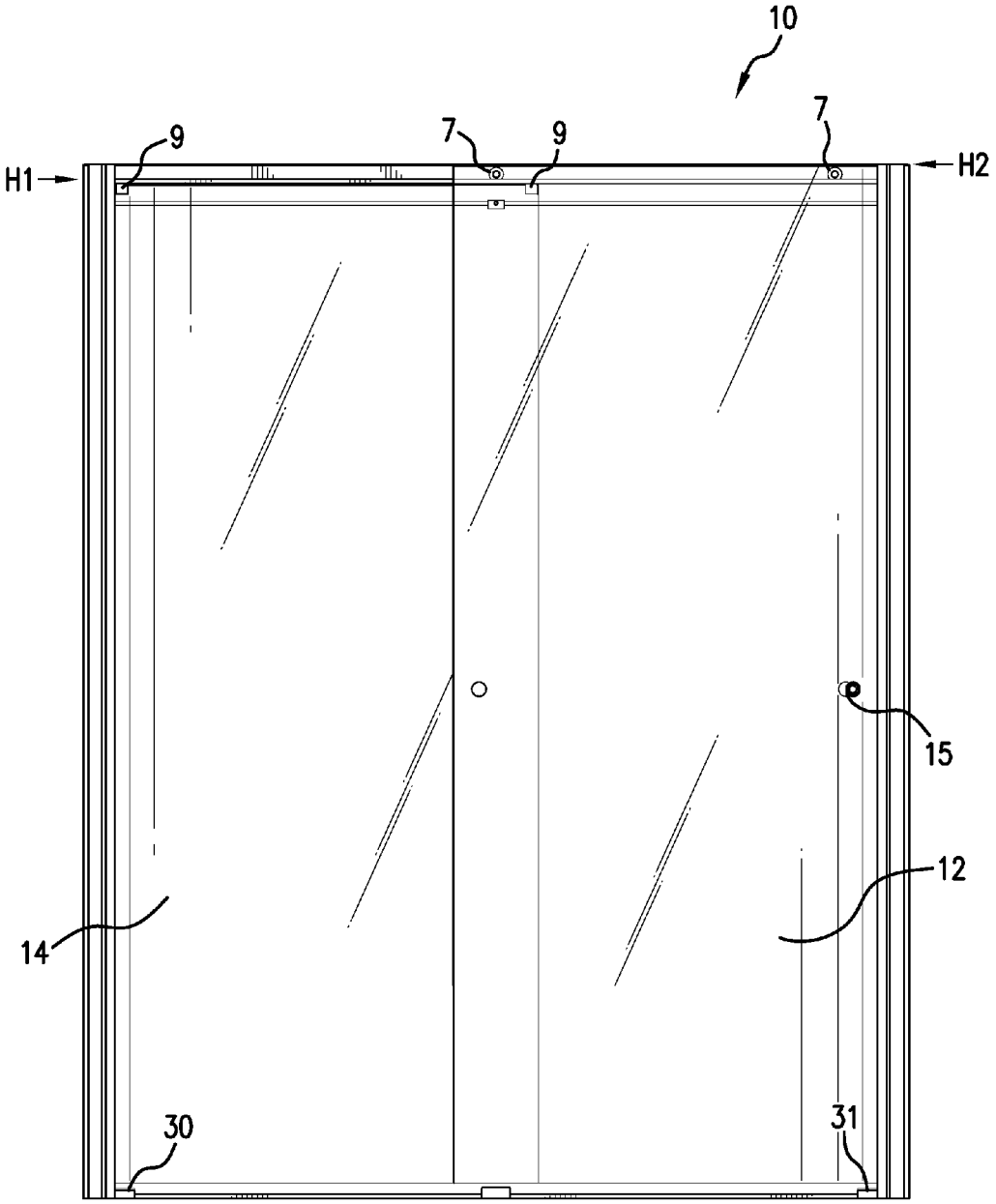
FIG. 14 is a back view showing a curved door with one side (the right door) fixed and the left door closed, according to the second embodiment.
Figure 15:
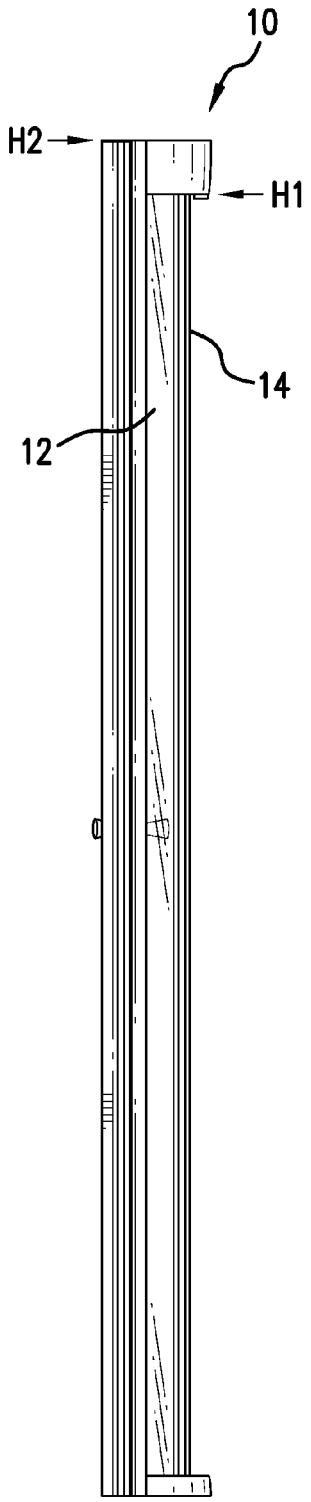
FIG. 15 is a right side view showing a curved door according to the second embodiment.
Figure 16:
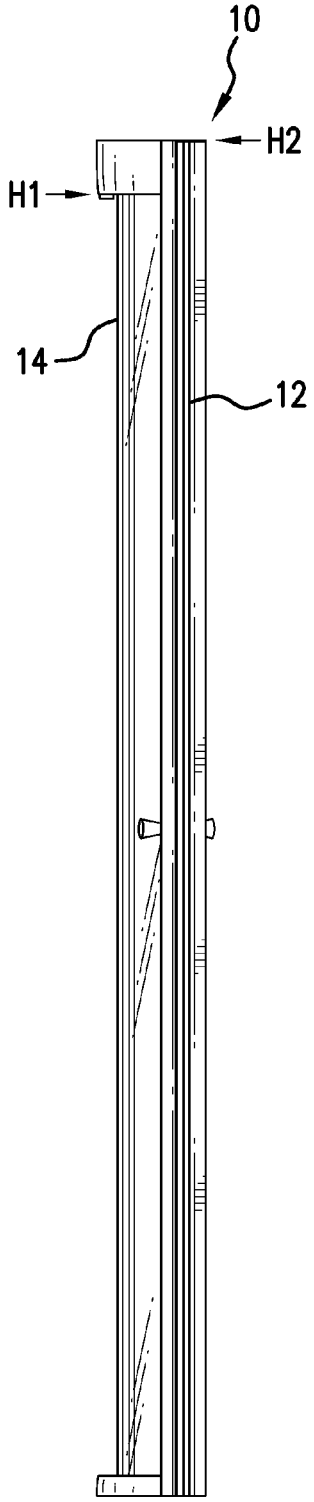
FIG. 16 is a left side view showing a curved door according to the second embodiment.
Figure 17:
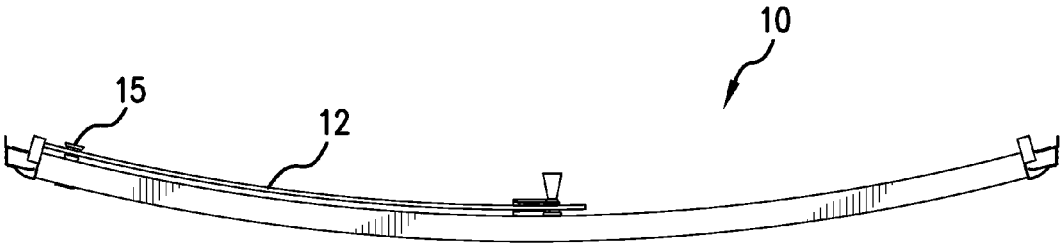
FIG. 17 is a top view showing a curved door according to the second embodiment, with the left door closed.
Figure 18:
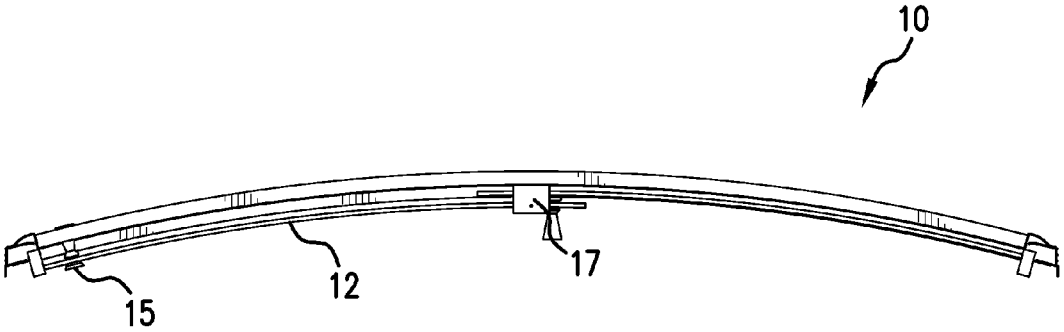
FIG. 18 is a bottom view showing a curved door according to the second embodiment, with the left door closed.
Figure 19:
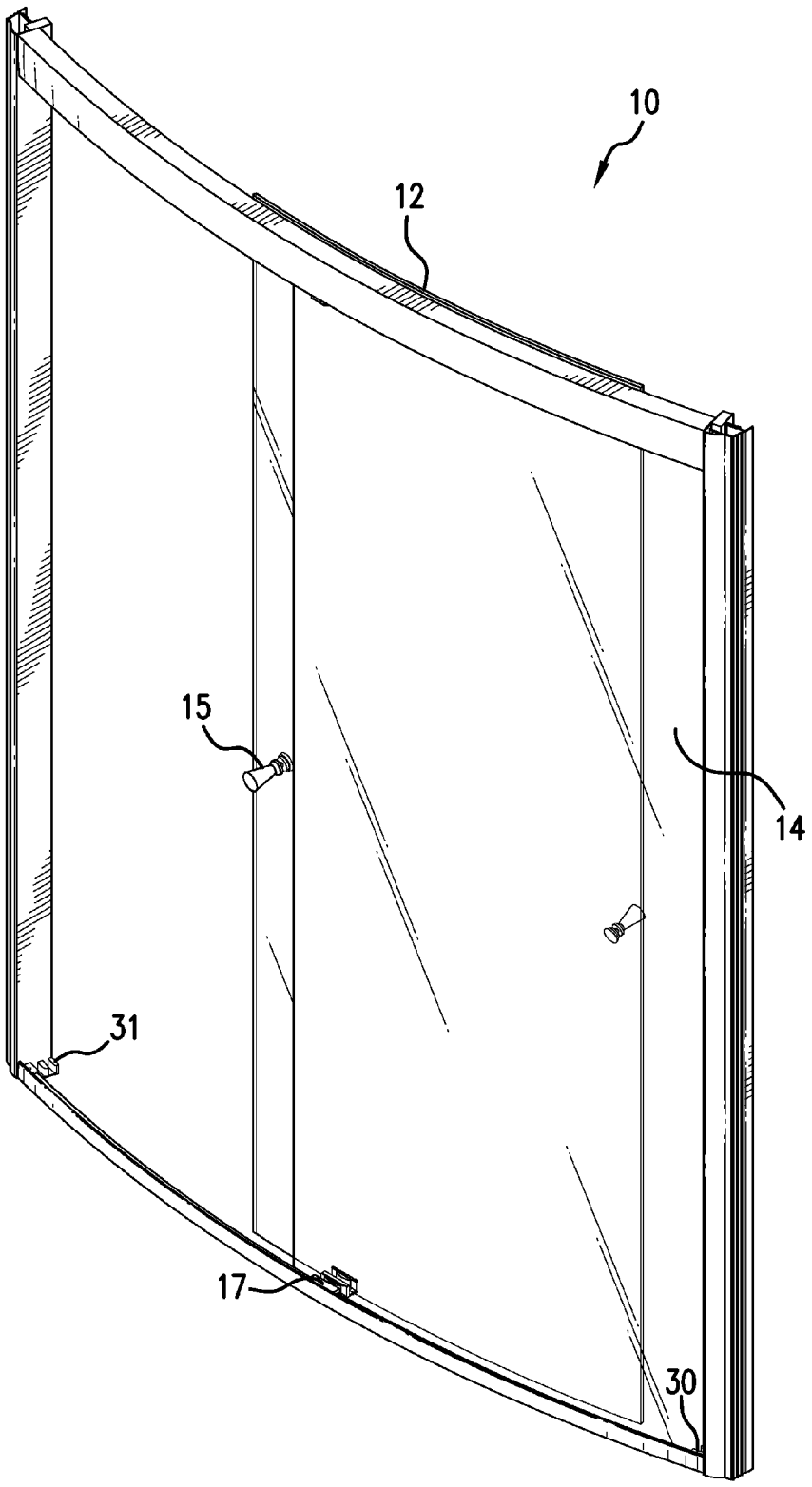
FIG. 19 is a perspective view showing a perspective view of a curved door with one side (the right door) fixed and the left door open, according to the second embodiment.
Figure 20:
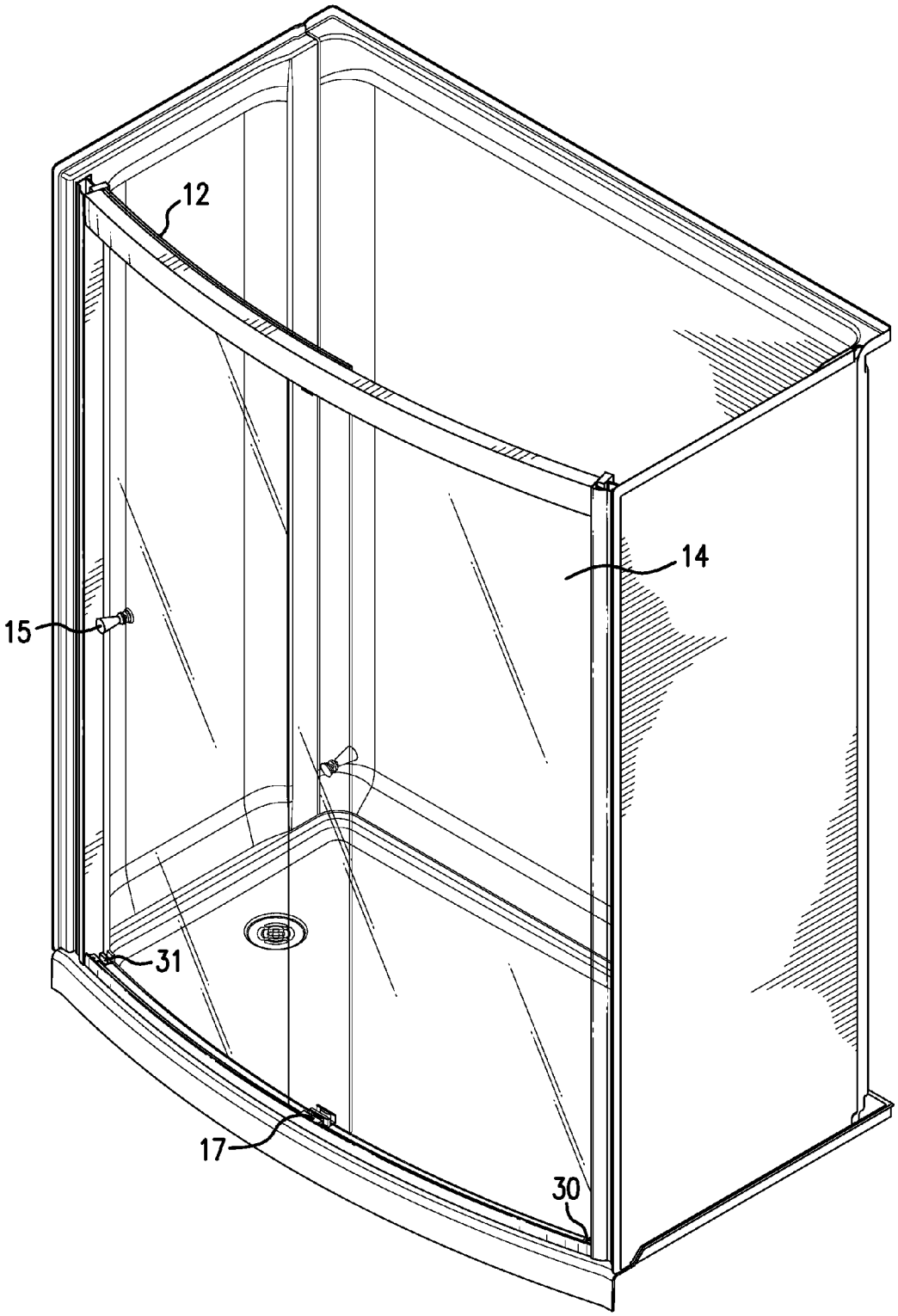
FIG. 20 is a perspective view showing a curved door with one side (the right door) fixed and the left door closed, according to the second embodiment, as used with a shower.
Figure 21:
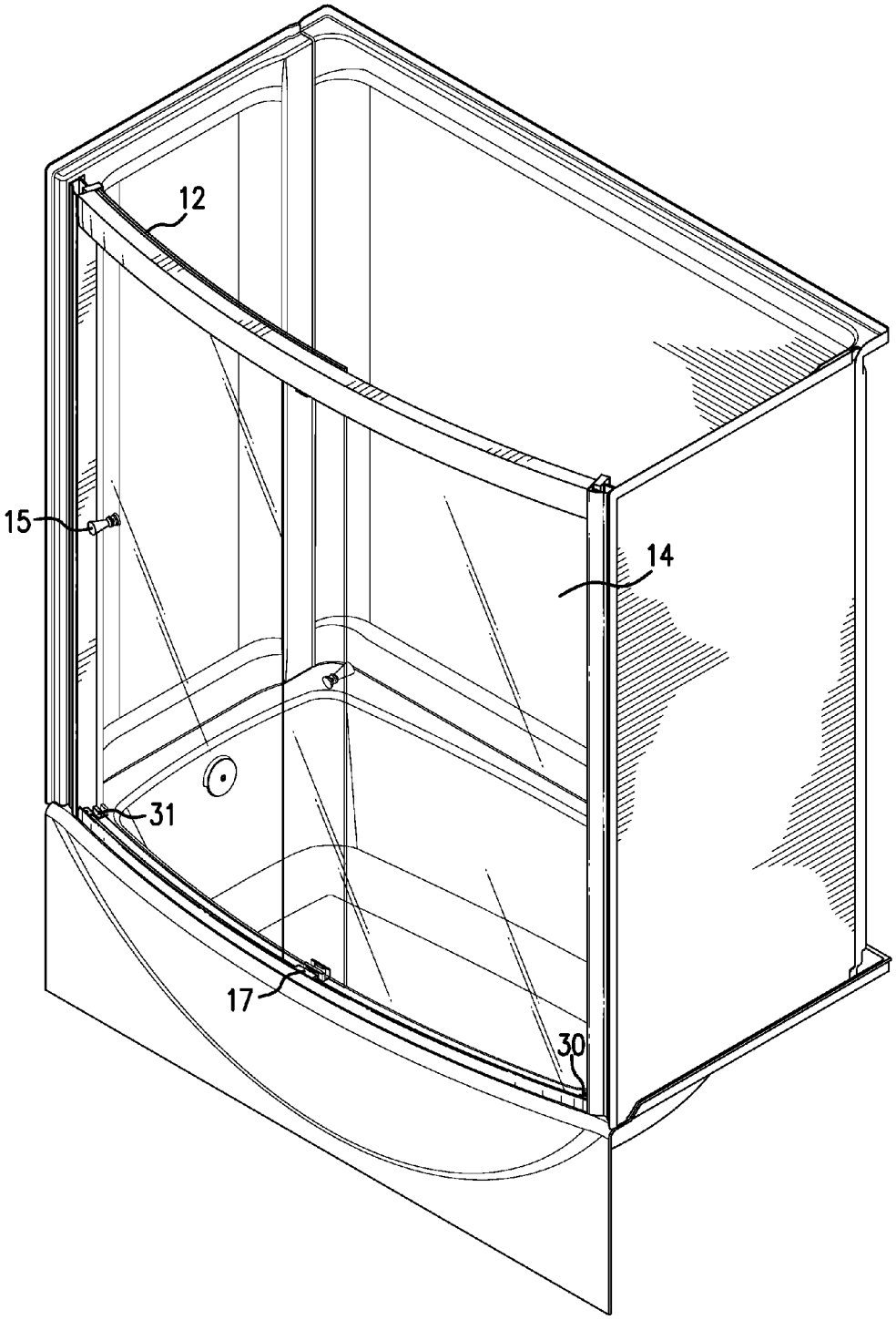
FIG. 21 is a perspective view showing a curved door with one side (the right door) fixed and the left door closed, according to the second embodiment, as used with a tub.

The configuration in FIG. 24 is similar to the configuration in FIG. 22 except that the roller 5 for the front (fixed) door 4 has been replaced with a guide 9 for receiving or holding the front door 4 in place. In a preferred embodiment two guides 9 are employed, one at each end of the door 4, with the guide that is employed towards the middle of the two panel doors acting as a stopper to prevent movement of the fixed door. The back view in FIG. 14 shows an example of the placement of the rollers 7 and guides 9 according to this embodiment.

Figure 25A:
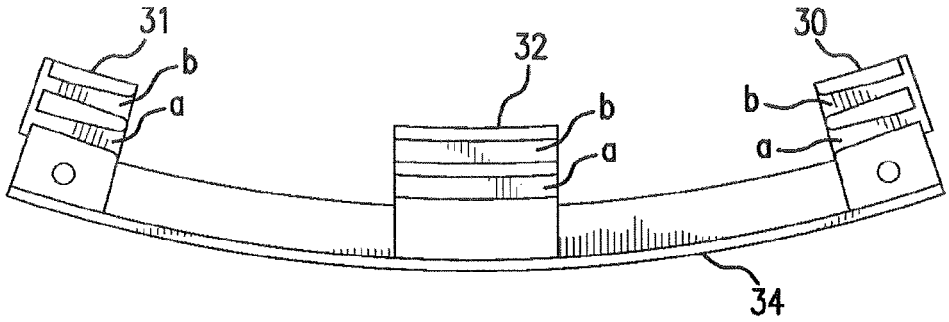
FIG. 25A is a top view of a lower track according to an embodiment of the present invention.
Figure 25B:
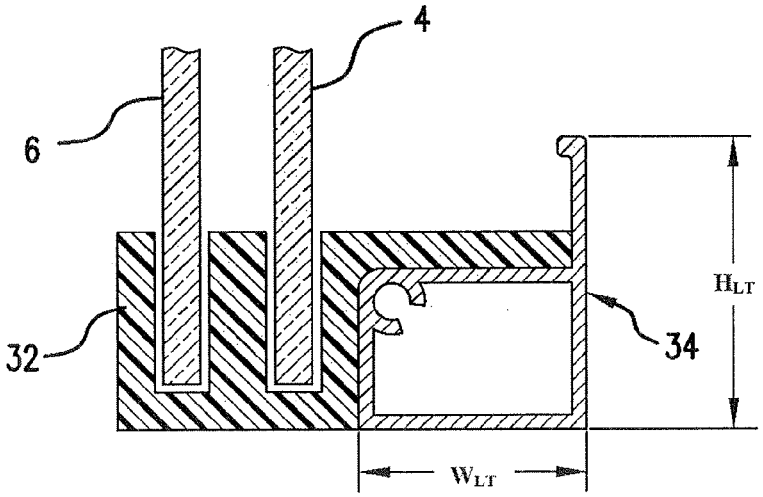
FIG. 25B is a cross-sectional view of the lower track shown in FIG. 25A.

FIGS. 25A and 25B illustrate views of the lower track according to an example aspect. The arrangement of the lower track 34 and guides 30, 31, and 32 shown in FIGS. 25A and 25B is suitable for both the bypass embodiment and the embodiment where one door slides and the other door is fixed. FIG. 25A is a top view of the lower track 34 without the doors being shown.

In the bypass arrangement, middle guide 32 of FIG. 25A contains the sliding doors, which are hung from the upper track using rollers as described previously, in the respective areas designated a and b. The doors slide within middle guide 32 and are received either by end guide 30 or by end guide 31 in the designated respective areas a and b. FIG. 25B is a cutout side view showing the middle guide 32 mated with the track 34. As shown in FIG. 25B, the front door 4 and the rear door 6 slide within the middle guide 32.

In the arrangement wherein one door is fixed and the other door slides, both the fixed door (e.g., the front door) and the sliding door (e.g., the back door) are contained by the middle guide 32. Let us assume that the left door is the sliding door 6 and the right door is the fixed door 4. The left (sliding) door 6, hung from the upper track using rollers, would slide within area b the middle guide 32, and would be received either by area b of the end guide 30 or by area b of the end guide 31. The right (fixed) door 4 would then sit in area a of guide 30 and area a of guide 32 and be supported thereby.

Figure 25C:
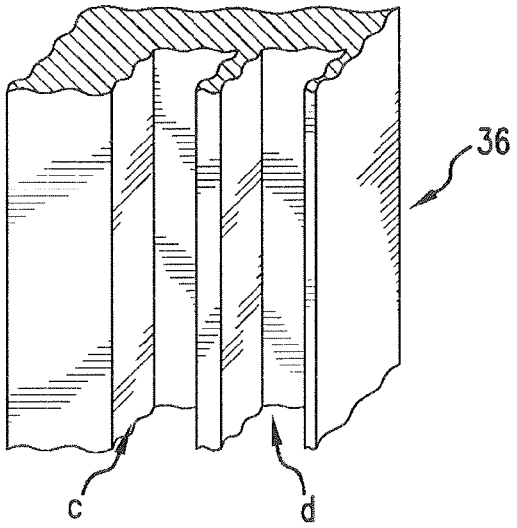
FIG. 25C illustrates a vertical track that is employed on each end of the curved shower door according to an embodiment of the present invention.
Figure 25D:
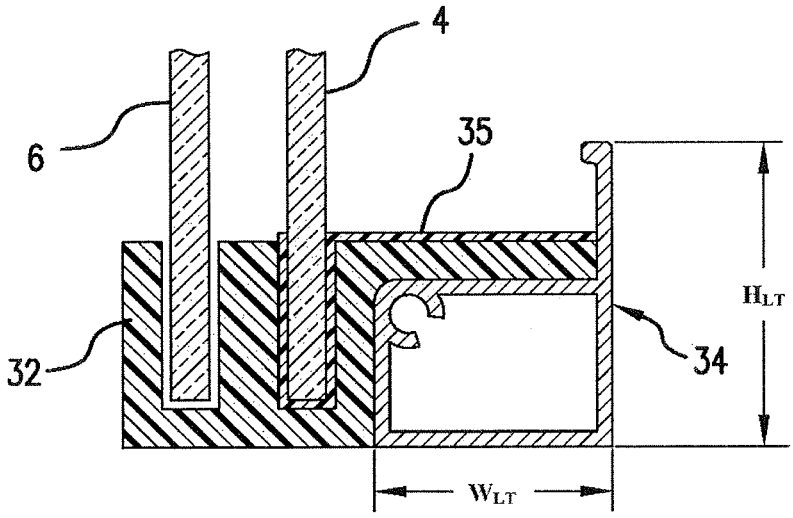
FIG. 25D is a cross-sectional view of the lower track shown in FIG. 25A and also showing a spacer.

Spacers can be used with the guides if needed to help prevent front-to-back movement or "rattling" of the doors and to support the weight of the fixed door. Thus, if needed to hold the doors more tightly within (particularly for a fixed door), spacers can be employed in areas a and b to provide a narrower area for the door(s) to be received in. For example, in a preferred embodiment as shown in FIG. 25D, a spacer 35 is used with the guide 32 for the fixed door 4 to restrict the fixed door's front-to-back movement and prevent rattling of the fixed door, and also to support the weight of the fixed door. The spacer 35 is disposed between the fixed door 4 and the surrounding walls and floor of the guide 32 in the area desired.

It is noted that in FIGS. 25B and 25D, both doors are shown as extending to the bottom of the guide (here, guide 32) but in alternative embodiments one of the doors (e.g., the rear door 6) may hang a little higher than the other door. A spacer could be employed in any area between a door and a portion of the guide 32 adjacent to the door. With this configuration of the lower track, the height of the lower track 34 can be reduced and thereby relatively short, which decreases the chance that a person will trip over the lower track 34 when getting into the shower or tub. The lower track is preferably caulked in place to hold it to the bottom of the shower or tub; of course, other suitable methods may be employed as well, such as double sided tape. FIG. 25C shows a vertical track 36 that is employed on each end of the curved shower door to receive (in recesses c and d) each door panel according to an embodiment of the invention.

Example Dimensions and Materials

Example dimensions are as follows. In one example embodiment, the shower door is approximately 70" in height and fits an opening of approximately 44-48" in width with some room for adjustment due to variations in existing wall installation. Particular example dimensions are approximately 70"×59" and 70"×57". The curved door may fit for example a 48" curved shower base or a 60" curved shower base. In the prior art shown in FIG. 26, example dimensions for the "C" shaped track of a straight door have a width of the track W equal to 2 inches and a height of the track H equal to 2 inches. Example dimensions of the upper track according to preferred embodiments of the invention shown in FIGS. 22 and 24 have W equal to 1.5 inches and H equal to 3 inches. Example dimensions of the lower track according to preferred embodiments of the claimed invention shown in FIGS. 25B and 25D have a width of the track $W_{LT}$ equal to 0.75 inches and a height of the track $H_{LT}$ equal to 1 inch. It is of course to be understood that these dimensions are just examples and are not meant to be limiting.

The curved door can be made out of, e.g., glass, frosted glass, or any other suitable material. Chrome (aluminum finish) may be desired, or satin (brushed nickel) finish. It is of course to be understood that these dimensions are just examples and are not meant to be limiting.

While the invention has been particularly shown and described with respect to preferred embodiment(s) thereof, it should be understood that the embodiment(s) have been presented by way of example, and not limitation. It will be apparent to persons skilled in the relevant art(s) that various changes in form and detail can be made therein without departing from the spirit and scope of the present invention. Thus, the present invention should not be limited by any above-described exemplary embodiment, but should be defined only in accordance with the following claims and their equivalents.

In addition, it should be understood that the figures illustrated in the attachments, which highlight the functionality and advantages of the present invention, are presented for example purposes only. The architecture of the present invention is sufficiently flexible and configurable, such that it may be utilized (and navigated) in ways other than that shown in the accompanying figures.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way. It is also to be understood that the steps and processes recited in the claims need not be performed in the order presented.

Having described the invention, what is claimed as new and secured by Letters Patent is:

What is claimed is:

1. A curved bypass door, comprising:

a first door comprising a first panel curved along an entirety thereof and a first roller, the first roller being attached to the first panel by an axle that extends directly from the first panel;

a second door comprising a second panel curved along an entirety thereof and a second roller, the second roller being attached to the second panel by an axle that extends directly from the second panel; and an elongated upper track having a lower rail adapted to receive the first roller of the first door and an upper rail adapted to receive the second roller of the second door, wherein said upper track has a width when viewed in cross-section, and the second door is spaced apart from the first door along the width of the upper track, the second roller of the second door is directly above the first panel of the first door, the second panel of the second door has a height higher than a height of the first panel of the first door, the first door and the second door are curved, and the upper track is curved to match a curved shape of the first and second doors.

2. The curved bypass door of claim 1, wherein the upper track is made of aluminum.

3. The curved bypass door of claim 1, further comprising a lower track attached to at least one lower guide, the at least one lower guide having slots to receive a bottom of the first panel of the first door and a bottom of the second panel of the second door.

4. The curved bypass door of claim 3, wherein the lower track is made of aluminum.

5. The curved bypass door of claim 3, wherein the lower track is curved to match the curved shape of the first and second doors.

6. A tub having the curved bypass door of claim 1.

7. A shower having the curved bypass door of claim 1.

8. A curved door, comprising:

a first panel curved along an entirety thereof that is fixed to at least one guide for fixing the first panel in place;

a door comprising a second panel curved along an entirety thereof and a roller, the roller being attached to the second panel by an axle that extends directly from the second panel; and an elongated upper track having an upper rail adapted to receive the roller of the second door and a lower rail adapted to receive the at least one guide fixed to the first panel, wherein said upper track has a width when viewed in cross-section, and the door is spaced apart from the first panel along the width of the upper track, the roller of the door is directly above the first panel, the second panel of the door has a height higher than a height of the first panel, the first panel and the door are curved, and the upper track is curved to match a curved shape of the first panel and the doors.

9. The curved door of claim 8, wherein the upper track is made of aluminum.

10. The curved door of claim 8, further comprising a lower track attached to at least one lower guide, the at least one lower guide having slots to receive a bottom of the first panel and a bottom of the second panel of the door.

11. The curved door of claim 10, wherein the lower track is made of aluminum.

12. The curved door of claim 10, wherein the lower track is curved to match the curved shape of the first panel and the door.

13. The curved door of claim 10, wherein a spacer is fitted to the slot of the lower guide that receives the bottom of the first panel.

14. A shower having the curved door of claim 8.

15. A tub having the curved door of claim 8.

* * * * *